US009850023B2

(12) United States Patent
Gonzalez

(10) Patent No.: US 9,850,023 B2
(45) Date of Patent: Dec. 26, 2017

(54) CARTON WITH DISPENSING FEATURE

(71) Applicant: Graphic Packaging International, Inc., Atlanta, GA (US)

(72) Inventor: Ana Gonzalez, Barcelona (ES)

(73) Assignee: Graphic Packaging International, Inc., Atlanta, GA (US)

( * ) Notice: Subject to any disclaimer, the term of this patent is extended or adjusted under 35 U.S.C. 154(b) by 666 days.

(21) Appl. No.: 13/803,784

(22) Filed: Mar. 14, 2013

(65) Prior Publication Data

US 2014/0096488 A1 Apr. 10, 2014

Related U.S. Application Data

(60) Provisional application No. 61/744,941, filed on Oct. 5, 2012.

(51) Int. Cl.
*B65D 77/38* (2006.01)
*B65D 17/00* (2006.01)
(Continued)

(52) U.S. Cl.
CPC ..... *B65D 5/542* (2013.01); *B65D 71/36* (2013.01); *B65D 2571/0066* (2013.01);
(Continued)

(58) Field of Classification Search
CPC ..... B65D 5/54; B65D 77/38; B31B 17/00
(Continued)

(56) References Cited

U.S. PATENT DOCUMENTS 1,416,465 A 5/1922 Harvey
1,434,165 A 10/1922 Ten Eyck
(Continued)

FOREIGN PATENT DOCUMENTS

DE 80 22 379.6 10/1981
FR 583 086 1/1925
(Continued)

OTHER PUBLICATIONS

International Search Report and Written Opinion for PCT/US2013/031229 dated Jun. 26, 2013.
(Continued)

*Primary Examiner* — Stephen F Gerrity
*Assistant Examiner* — Mary Hibbert
(74) *Attorney, Agent, or Firm* — Womble Bond Dickinson (US) LLP

(57) ABSTRACT

A carton for holding a plurality of containers. The carton comprises a plurality of panels that extends at least partially around an interior of the carton. The plurality of panels comprises at least one top panel, at least one side panel foldably connected to the at least one top panel, and a bottom panel foldably connected to the at least one side panel. The carton further comprises a support foldably connected to the top panel for supporting at least one article of the plurality of articles and a dispenser for allowing removal of the plurality of articles from the carton. The dispenser comprises a dispenser panel that is at least partially defined by a tear line in the at least one side panel and the at least one top panel. The dispenser panel is for being at least partially removed for at least further opening a dispenser opening.

48 Claims, 13 Drawing Sheets

(51) Int. Cl.
*B65D 5/54* (2006.01)
*B65D 71/36* (2006.01)

(52) U.S. Cl.
CPC ..... *B65D 2571/00141* (2013.01); *B65D 2571/00308* (2013.01); *B65D 2571/00561* (2013.01); *B65D 2571/00574* (2013.01); *B65D 2571/00728* (2013.01)

(58) Field of Classification Search
USPC ..... 53/456; 493/51, 114; 229/223, 122; 206/427, 746, 429
See application file for complete search history.

(56) References Cited

U.S. PATENT DOCUMENTS

| | | | | |
|---|---|---|---|---|
| 1,732,226 | A | 10/1929 | Darragh | |
| 1,862,685 | A | 6/1932 | Kennett | |
| 1,889,625 | A | 11/1932 | Barter | |
| 1,909,472 | A | 5/1933 | Keppler | |
| 2,005,924 | A | 6/1935 | Wilson | |
| 2,052,675 | A | 9/1936 | Tanner | |
| 2,294,965 | A | 9/1942 | Davidson | |
| 2,312,595 | A | 3/1943 | Smith | |
| 3,178,242 | A | 4/1965 | Ellis et al. | |
| 3,263,861 | A | 8/1966 | Carr | |
| 3,640,448 | A | 2/1972 | Wood | |
| 3,963,121 | A | 6/1976 | Kipp | |
| 4,030,596 | A | 6/1977 | Snyder et al. | |
| 4,066,207 | A | 1/1978 | Jorgensen-Beck et al. | |
| 4,331,231 | A | 5/1982 | Boyle | |
| 4,433,778 | A | 2/1984 | Maio et al. | |
| 4,836,375 | A | 6/1989 | Schuster | |
| 5,000,313 | A | 3/1991 | Oliff | |
| 5,180,054 | A | 1/1993 | Bakx | |
| 5,351,878 | A | 10/1994 | Cooper | |
| 5,375,702 | A | 12/1994 | Fiallo | |
| 5,549,197 | A | 8/1996 | Sutherland | |
| 5,690,230 | A | 11/1997 | Griffith | |
| 5,878,947 | A | 3/1999 | Hoy et al. | |
| 5,899,377 | A | 5/1999 | Speese et al. | |
| 6,029,886 | A | 2/2000 | Sheffer | |
| 6,123,222 | A | 9/2000 | Richiger et al. | |
| 6,227,367 | B1 | 5/2001 | Harrelson et al. | |
| 6,341,689 | B1 | 1/2002 | Jones | |
| 6,422,454 | B1 | 7/2002 | Barr et al. | |
| 6,478,219 | B1 | 11/2002 | Holley, Jr. | |
| 6,578,736 | B2 | 6/2003 | Spivey | |
| 6,604,677 | B1 | 8/2003 | Sutherland et al. | |
| 6,848,573 | B2 | 2/2005 | Gould et al. | |
| 6,866,185 | B2 | 3/2005 | Harrelson | |
| 6,902,104 | B2 | 6/2005 | Holley, Jr. et al. | |
| 6,918,487 | B2 | 7/2005 | Harrelson | |
| 6,997,316 | B2 | 2/2006 | Sutherland | |
| 7,000,803 | B2 | 2/2006 | Miller | |
| 7,004,897 | B2 | 2/2006 | Spivey, Sr. | |
| 7,073,665 | B2 | 7/2006 | Auclair et al. | |
| 7,097,034 | B2 | 8/2006 | Woog | |
| 7,104,435 | B2 | 9/2006 | Holley, Jr. | |
| 7,147,143 | B2 | 12/2006 | Cargile | |
| 7,296,731 | B2 | 11/2007 | Auclair et al. | |
| 7,604,157 | B2 | 10/2009 | Zammit et al. | |
| 7,658,317 | B2 | 2/2010 | Wilkins | |
| 7,699,163 | B2 * | 4/2010 | Gomes et al. | 206/162 |
| 7,703,666 | B2 | 4/2010 | Hand et al. | |
| 7,743,972 | B2 | 6/2010 | Fogle | |
| 7,762,394 | B2 * | 7/2010 | Bradford et al. | 206/427 |
| 7,913,875 | B2 | 3/2011 | Goddard et al. | |
| 7,918,384 | B2 | 4/2011 | Gomes et al. | |
| 7,966,789 | B2 | 6/2011 | Hand et al. | |
| 8,011,567 | B2 | 9/2011 | DeBusk et al. | |
| 8,118,212 | B2 | 2/2012 | Miller | |
| 8,439,194 | B2 | 5/2013 | Spivey | |
| 2002/0070139 | A1 | 6/2002 | Bates | |
| 2003/0159079 | A1 | 8/2003 | White | |
| 2004/0238611 | A1 | 12/2004 | Sutherland | |
| 2006/0081691 | A1 | 4/2006 | Smalley | |
| 2006/0118606 | A1 | 6/2006 | Holley, Jr. et al. | |
| 2007/0164093 | A1 * | 7/2007 | Spivey, Sr. | B65D 71/36 229/122 |
| 2011/0290692 | A1 * | 12/2011 | Spivey, Sr. | B65D 71/36 206/433 |
| 2012/0091021 | A1 * | 4/2012 | Smalley | B65D 71/36 206/427 |
| 2012/0138667 | A1 | 6/2012 | Burke et al. | |
| 2012/0145775 | A1 | 6/2012 | Miller | |
| 2012/0211552 | A1 | 8/2012 | Kastanek et al. | |
| 2013/0134211 | A1 | 5/2013 | Linkel | |

FOREIGN PATENT DOCUMENTS

| | | |
|---|---|---|
| FR | 1 324 316 | 4/1963 |
| FR | 2 549 010 | 1/1985 |
| FR | 2 841 216 | 12/2003 |
| GB | 1 242 723 | 8/1971 |
| GB | 1 395 644 | 5/1975 |
| GB | 2 115 383 | 9/1983 |
| NZ | 509745 | 8/2003 |
| WO | WO 00/76863 | 12/2000 |
| WO | WO 2004/087507 | 10/2004 |
| WO | WO 2005/014421 | 2/2005 |

OTHER PUBLICATIONS

Supplementary European Search Report for EP 13 84 3925 dated Apr. 5, 2016.

* cited by examiner

CARTON WITH DISPENSING FEATURE

CROSS-REFERENCE TO RELATED APPLICATIONS

This application claims the benefit of U.S. Provisional Patent Application No. 61/744,941 filed Oct. 5, 2012.

INCORPORATION BY REFERENCE

The disclosure of U.S. Provisional Patent Application No. 61/744,941, which was filed on Oct. 5, 2012, is hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons having at least one dispensing feature.

SUMMARY OF THE DISCLOSURE

In general, one aspect of the disclosure is directed to a carton for holding a plurality of articles. The carton comprises a plurality of panels that extends at least partially around an interior of the carton. The plurality of panels comprises at least one top panel, at least one side panel foldably connected to the at least one top panel, and a bottom panel foldably connected to the at least one side panel. The carton further comprises a support foldably connected to the top panel for supporting at least one article of the plurality of articles and a dispenser for allowing removal of the plurality of articles from the carton. The dispenser comprises a dispenser panel that is at least partially defined by a tear line in the at least one side panel and the at least one top panel. The dispenser panel is for being at least partially removed for at least further opening a dispenser opening.

In another aspect, the disclosure is generally directed to a blank for forming a carton. The blank comprises a plurality of panels comprising at least one top panel, at least one side panel foldably connected to the at least one top panel, and a bottom panel foldably connected to the at least one side panel. The blank further comprises a support foldably connected to the top panel for supporting at least one article of the plurality of articles and dispenser features for forming a dispenser for allowing removal of the plurality of articles from the carton. The dispenser features comprise a dispenser panel that is at least partially defined by a tear line in the at least one side panel and the at least one top panel. The dispenser panel is for being at least partially removed for at least further opening a dispenser opening in the carton formed from the blank.

In another aspect, the disclosure is generally directed to a method of forming a carton. The method comprises obtaining a blank comprising a plurality of panels. The plurality of panels comprises at least one top panel, at least one side panel foldably connected to the at least one top panel, and a bottom panel foldably connected to the at least one side panel. The blank further comprises a support foldably connected to the top panel and dispenser features for forming a dispenser for allowing removal of the plurality of articles from the carton. The dispenser features comprise a dispenser panel that is at least partially defined by a tear line in the at least one side panel and the at least one top panel. The method further comprises positioning the plurality of panels to form an interior of the carton and loading a plurality of articles in the interior of the carton. The loading the articles comprises positioning at least one article of the plurality of articles for contact with the support.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
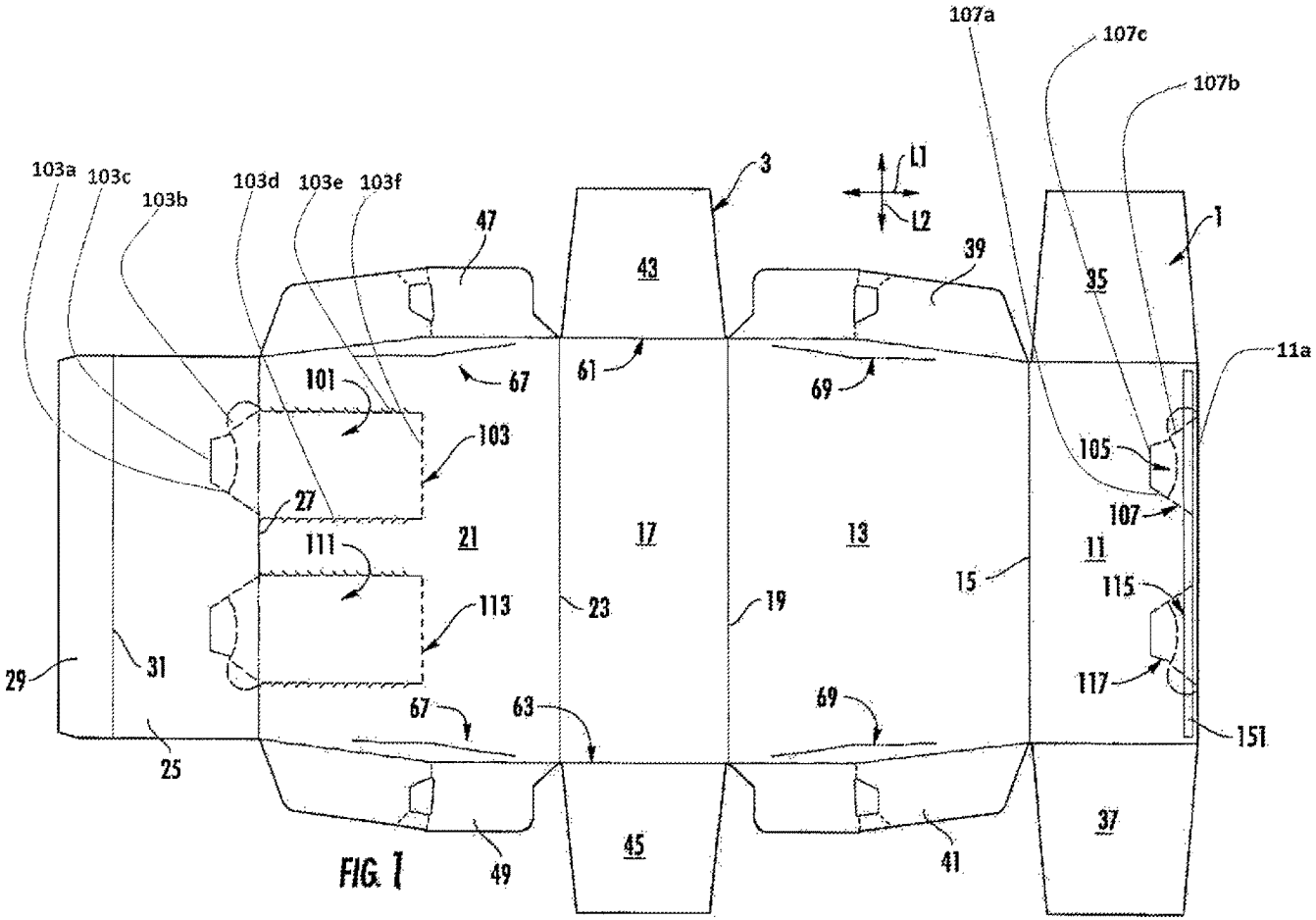
FIG. 1 is plan view of an exterior surface of a blank for forming a carton of the first embodiment.
Figures 2, 3, 4:
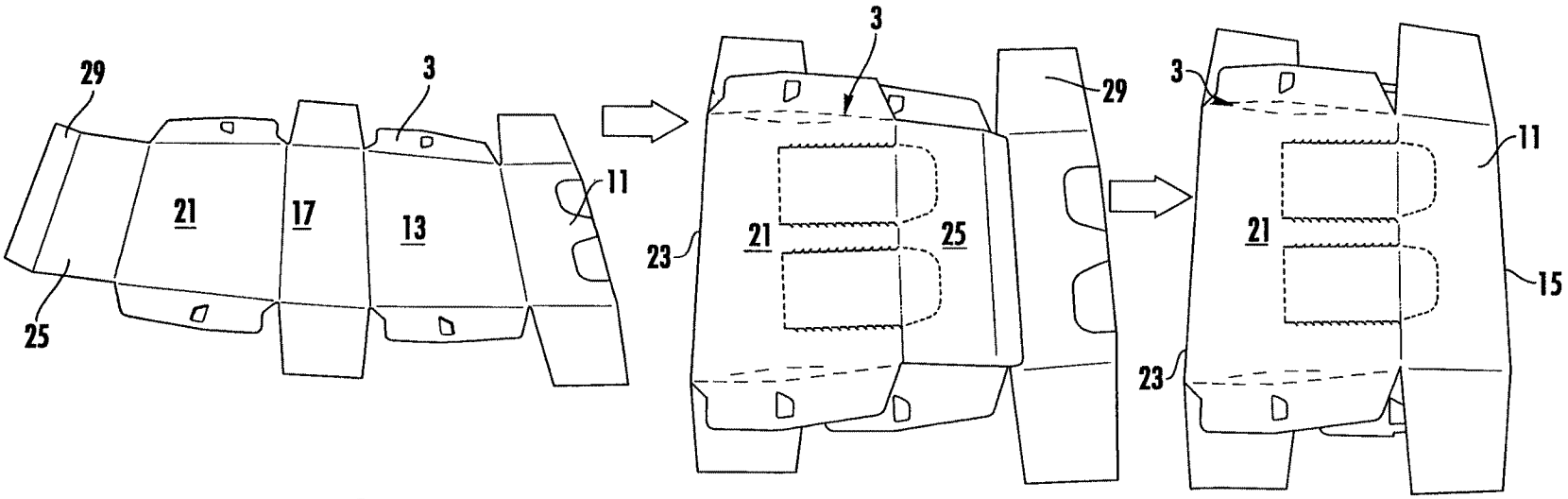
FIG. 2 is a view of an interior surface of the blank of FIG. 1.
FIGS. 3-6 are various views showing the blank of FIG. 1 being formed into the carton.
Figure 5:
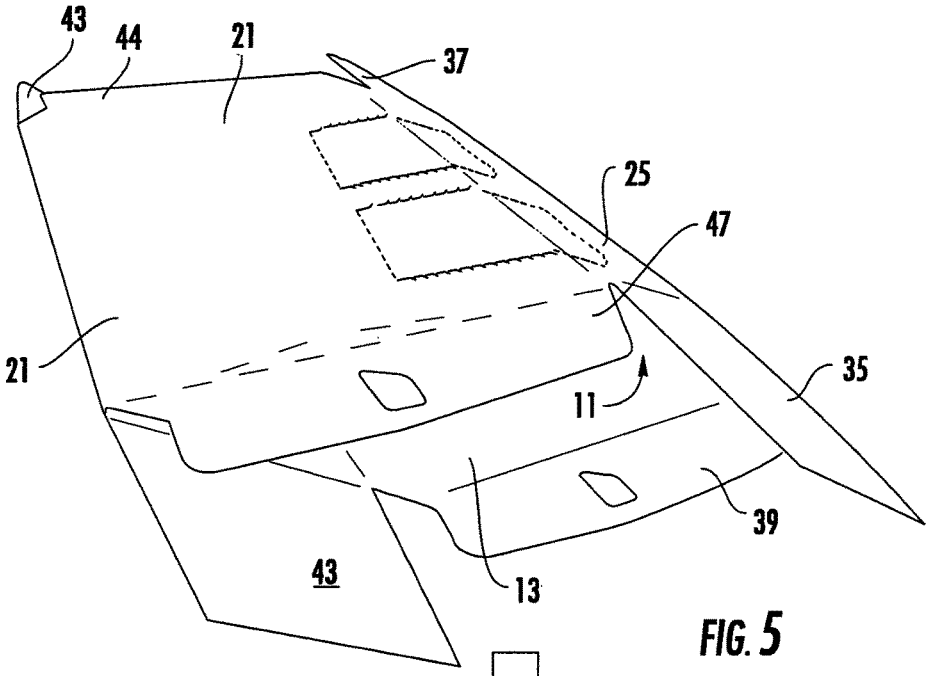
Figure 6:
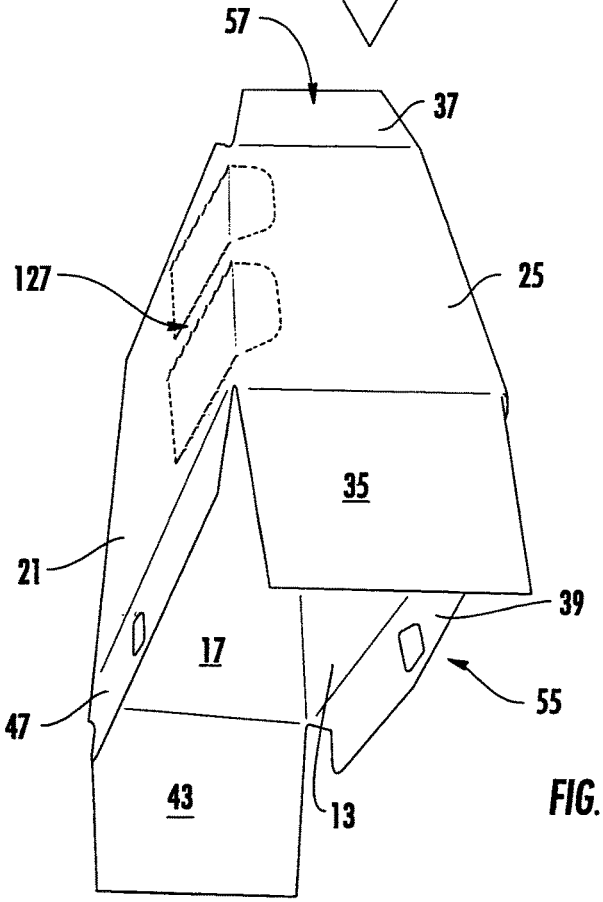
Figure 7:
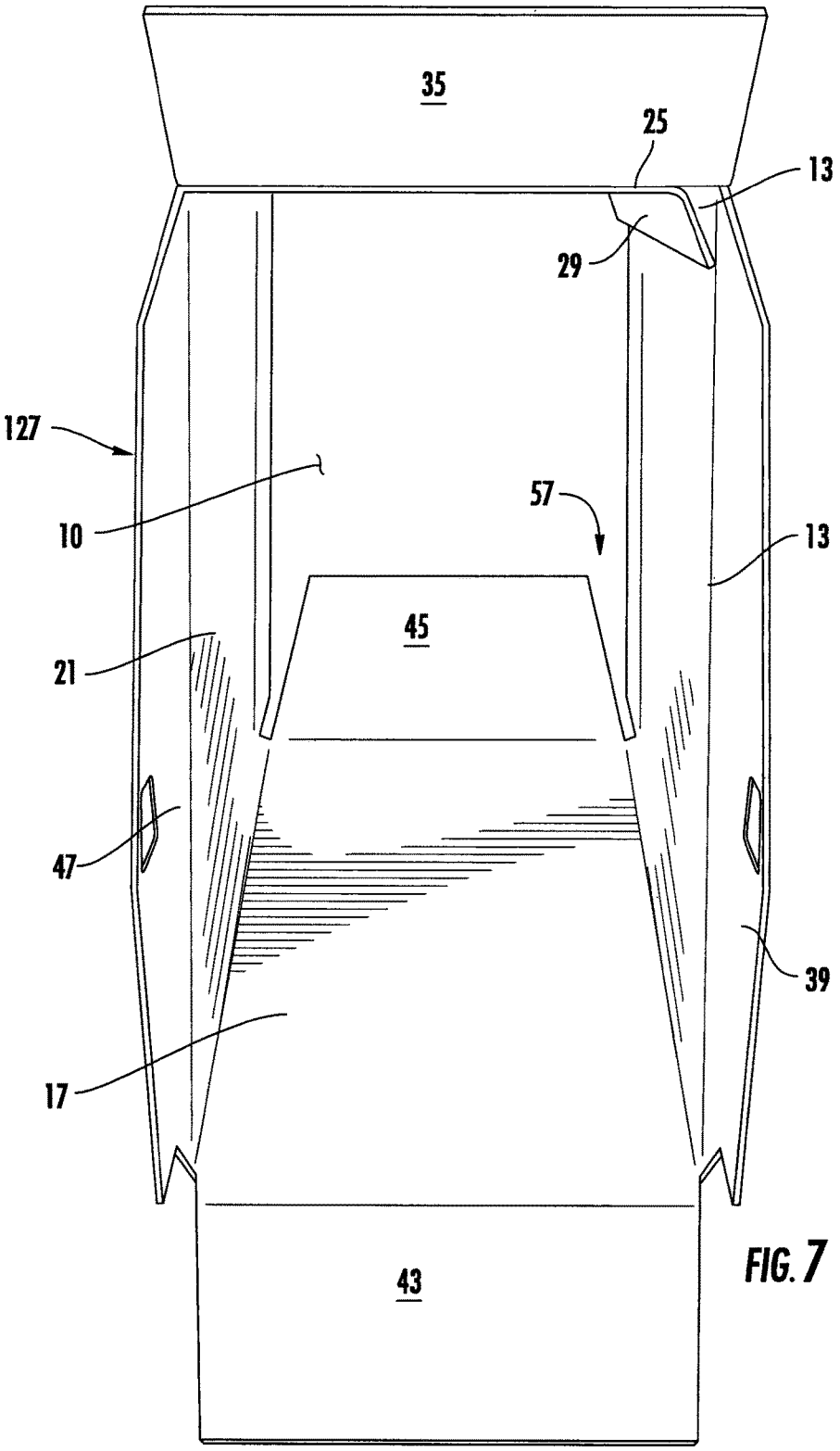
FIG. 7 is an end perspective view of the carton formed from the blank of FIG. 1 in an open configuration.
Figure 8:
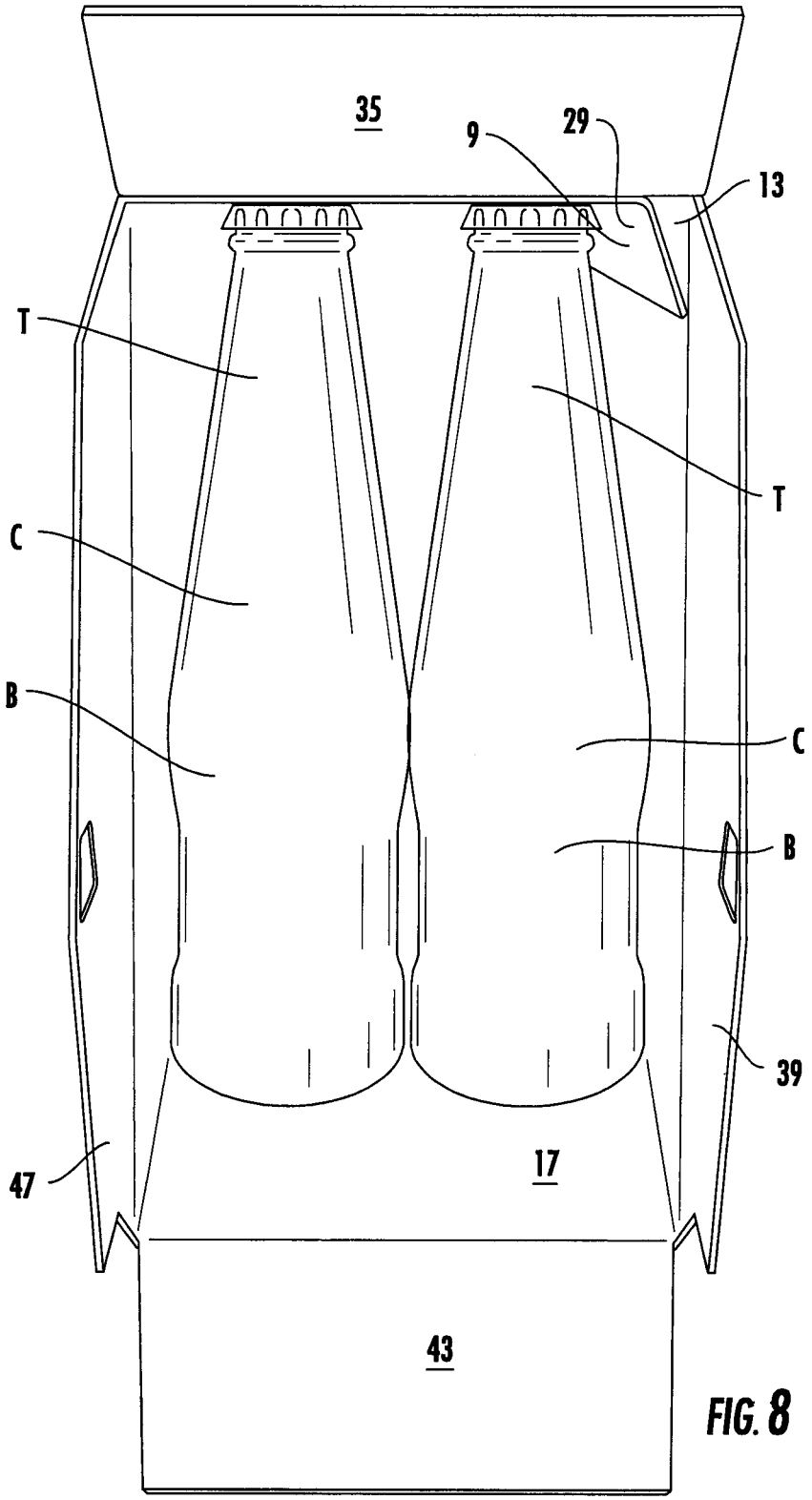
FIG. 8 is an end perspective view of the carton of FIG. 7 loaded with articles.

FIG. 1 is a plan view of the exterior side 1 of a blank, generally indicated at 3, used to form a carton 5 (FIG. 10) according to one exemplary embodiment of the disclosure. The carton 5 can be used to house a plurality of articles such as containers C (FIG. 8). In the illustrated embodiment, the carton 5 is sized to house twelve containers C in a 2×6 arrangement, but it is understood that the carton 5 may be sized and shaped to hold containers of a different or same quantity in more than one layer and/or in different row/column arrangements (e.g., 3×4, 1×6, 3×6, 2×6×2, 3×3×2, 4×5, 3×5, 2×9, 2×6, 3×4, etc.). In one embodiment, the carton 5 has a dispenser 7 for accessing the containers C in the carton. As will be discussed below in more detail, the dispenser 7 can be positioned to an open position (FIGS. 11-13) for accessing the containers C. The carton has a support 9 in an interior space 10 of the carton for supporting containers C prior to removal from the interior space through the dispenser 7.

In one embodiment, the carton blank 3 has a longitudinal axis L1 and a lateral axis L2. In the illustrated embodiment, the blank 3 comprises a first top panel 11 foldably connected to a first side panel 13 at a first lateral fold line 15. A bottom panel 17 is foldably connected to the first side panel 13 at a second lateral fold line 19. A second side panel 21 is foldably connected to the bottom panel 17 at a third lateral fold line 23. A second top panel 25 is foldably connected to the second side panel 21 at a fourth lateral fold line 27. In the illustrated embodiment, the blank 3 includes a support flap 29 foldably connected to the second top panel 25 at a fourth lateral fold line 31. In alternative embodiments, the blank 3 can have alternative panel and/or flap arrangements.

The first top panel 11 is foldably connected to a first top end flap 35 and a second top end flap 37. The first side panel 13 is foldably connected to a first side end flap 39 and a second side end flap 41. The bottom panel 17 is foldably connected to a first bottom end flap 43 and a second bottom end flap 45. The second side panel 21 is foldably connected to a first side end flap 47 and a second side end flap 49. When the carton 5 is erected, the top end flap 35, bottom end flap 43, and side end flaps 39, 47 close a first end 55 of the carton, and the top end flap 37, bottom end flap 45, and side end flaps 41, 49 close a second end 57 of the carton. In accordance with an alternative embodiment of the present disclosure, different flap arrangements can be used for at least partially closing the ends 55, 57 of the carton 5.

The top end flap 35, bottom end flap 43, and side end flaps 39, 47 extend along a first marginal area of the blank 3, and are foldably connected at a first longitudinal fold line 61 that extends along the length of the blank. The top end flap 37, bottom end flap 45, and side end flaps 41, 49 extend along a second marginal area of the blank 3, and are foldably connected at a second longitudinal fold line 63 that also extends along the length of the blank. The longitudinal fold lines 61, 63 may be, for example, substantially straight, or offset at one or more locations to account for blank thickness, varying width of the blank panels, or for other factors.

In the illustrated embodiment, the carton blank 3 includes features to form the carton 5 having tapered ends 55, 57. That is, the blank 3 includes diamond corner panels 67, 69 that connect respective side end flaps 47, 49, 39, 41 to a respective one of the second side panel 21 and the first side panel 13. The diamond corner panels 67, 69 are configured to allow the ends 55, 57 of the carton 5 to taper inwardly to the top of the carton. Each of the top panels 11, 25 can be shorter than the bottom panel 17 in the lateral direction L2, and the top of the carton formed from the partially overlapped top panels 11, 25 can be narrower between the ends 55, 57 than the bottom panel 17. The tapered upper portions of the side panels 13, 21 and the ends 55, 57 are for accommodating containers C that have a wide bottom portion B and a narrow top portion T (FIG. 8). Alternatively, the ends 55, 57 and the sides 13, 21 can taper inwardly from the bottom to the top of the carton. The containers C having a wide bottom B and narrow top T can be tightly held in the carton with the narrow tops of the containers located adjacent to the ends 55, 57 being located in close proximity to the portions of the fold lines 61, 63 connecting the top end flaps 35, 37 to the top panel 11. Also, the containers C located adjacent the first and second side panels 13, 21 can have the narrow tops of the containers located in close proximity to the fold lines 15, 27 to further enhance the tightness of the packing of the containers in the carton 5. In alternative embodiments, the carton 5 could be otherwise shaped, arranged, and/or configured.

In one embodiment, the dispenser 7 comprises a first dispenser panel 101 that is at least partially defined by a first tear line 103 and comprises a portion of the second side panel 21 and the second top panel 25, and a second dispenser panel 105 that is at least partially defined by a second tear line 107 and comprises a portion of the first top panel 11. In the illustrated embodiment, the dispenser 7 comprises a third dispenser panel 111 that is at least partially defined by a third tear line 113 and comprises a portion of the second side panel 21 and the second top panel 25, and a fourth dispenser panel 115 that is at least partially defined by a fourth tear line 117 and comprises a portion of the first top panel 11. When the blank 3 is formed into the carton 5, the second dispenser panel 105 overlaps the portion of the first dispenser panel 101 that is in the second top panel 25 and the fourth dispenser panel 117 overlaps the portion of the third dispenser panel 111 in the second top panel 25. The blank 3 further comprises an adhesive region 151 extending between fold lines 61, 63 for adhering the first top panel 11 and the second top panel 25 for forming the dispenser 7 from the first, second, third, and fourth dispenser panels 101, 105, 111, 115. The dispenser 7 could be otherwise shaped, arranged, configured such that one or more of the dispenser panels 101, 105, 111, 115 could have access features for accessing the dispenser panels and/or retaining features for retaining containers C in the carton 5. Further, the dispenser 7 could comprises less than or more than four dispenser panels without departing from the disclosure.

In one embodiment, the first tear line 103 includes a first portion 103*a*, a second portion 103*b*, a third portion 103*c*, a fourth portion 103*d*, a fifth portion 103*e*, and a sixth portion 103*f*. The first portion 103*a* and second portion 103*b* each extend from the fourth lateral fold line 27 and are in the second top panel 25. The fourth portion 103*d* and the fifth portion 103*e* each extend from the fourth lateral fold line 27 and are in the second side panel 21. The third portion 103*c* extends between the first portion 103*a* and the second portion 103*b*. In the illustrated embodiment, the second tear line 107 also includes a first portion 107*a*, a second portion 107*b*, and a third portion 107*c*. The first portion 107*a* and the second portion 107*b* each extend from a free edge 11*a* of the first top panel 11. The third portion 107*c* extends between the first portion 107*a* and the second portion 107*b*. When the carton 5 is formed from the blank 3, the respective portions 103*a*, 103*b*, and 103*c* of the first tear line 103 are in registration with the respective portions 107*a*, 107*b*, and 107*c* of the second tear line to form the dispenser 7. Additionally, the third tear line 113 and the fourth tear line 117 can be formed similarly to the first tear line 103 and second tear line 107 and have similarly shaped portions.

Figure 9:
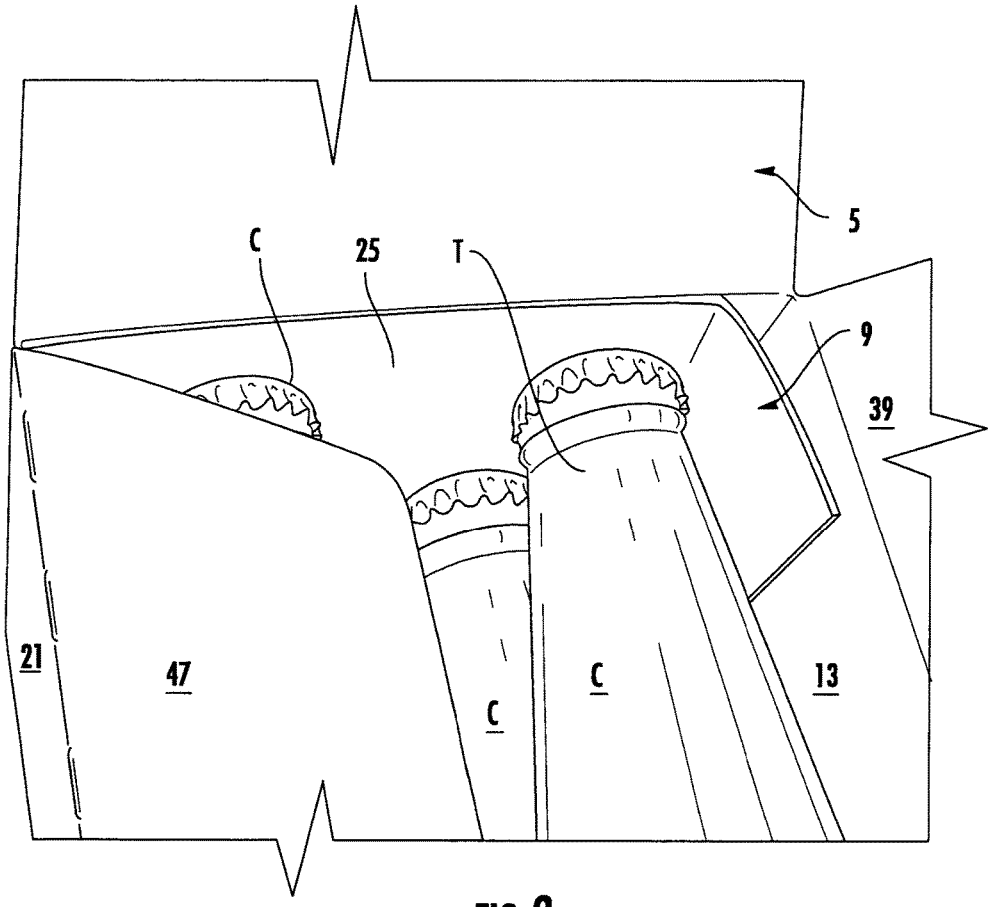
FIG. 9 is an enlarged view of a portion of the carton of FIG. 7.

In one exemplary embodiment shown in FIGS. 2-10, the carton 5 can be assembled from the blank 3 by initially folding the second side panel 21 and second top panel 25 along fold line 23 (FIG. 3) and then folding the first top panel 11 along fold line 15 so that the first top panel overlaps the second top panel 25 and the support flap 29. The first top panel 11 and second top panel can be secured in face-to-face contact by adhesive applied either to the interior surface of the first top panel 11 or the exterior surface of the second top panel 25. As shown in FIGS. 8-9, the support flap 29 forms the support 9 that is free from attachment to the first side panel 13 or the overlapped top panels 11, 25. In one embodiment, the support flap extends downwardly from the overlapped top panels 11, 25 at an angle with a free edge 121 of the flap being in contact with the first side panel 13. Alternatively, a portion of the support flap 29 can be secured to the first side panel 13 without departing from the disclosure.

Figure 10:
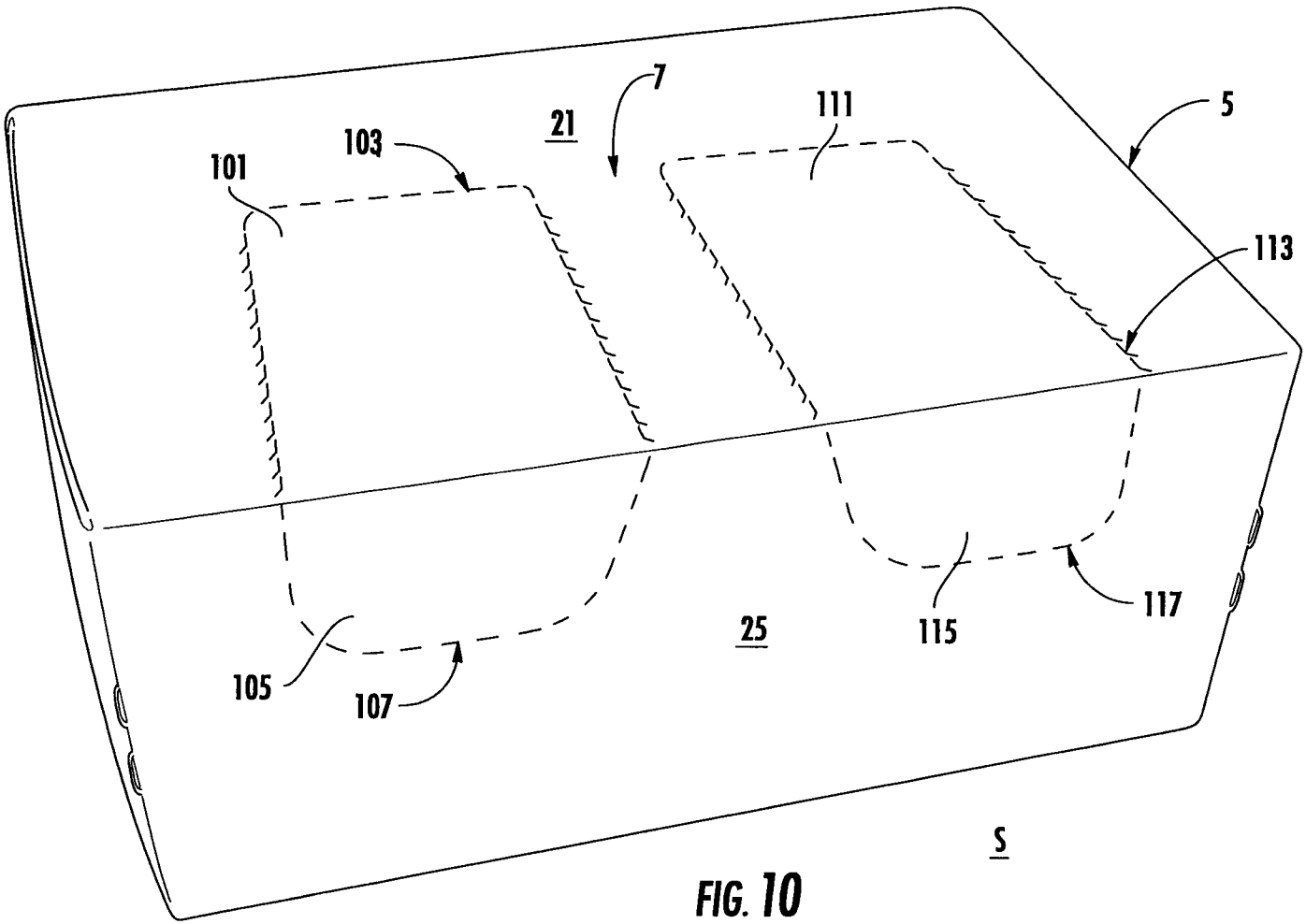
FIG. 10 is a perspective view of the carton formed from the blank of FIG. 1 in a closed configuration.

As shown in FIGS. 5-8 the side panels 13, 21 can then be positioned relative to the top panels 11, 25 and the bottom panel 17 to form a generally open-ended tubular sleeve 127 at least partially forming the interior space 10. The tubular sleeve 127 can be loaded with containers C (FIG. 8) prior to closing the ends 55, 57 of the carton 5, or one of the ends can be closed prior to loading the containers. Once the containers C are loaded, the ends 55, 57 of the sleeve 127 can be closed to form the closed carton 5, as illustrated by FIG. 10, by at least partially overlapping the end flaps 35, 39, 43, 47 to close the first end 55, and at least partially overlapping the end flaps 37, 41, 45, 49 to close the second end 57. The carton 5 can be assembled and loaded by other positioning steps without departing from the disclosure.

Figure 12:
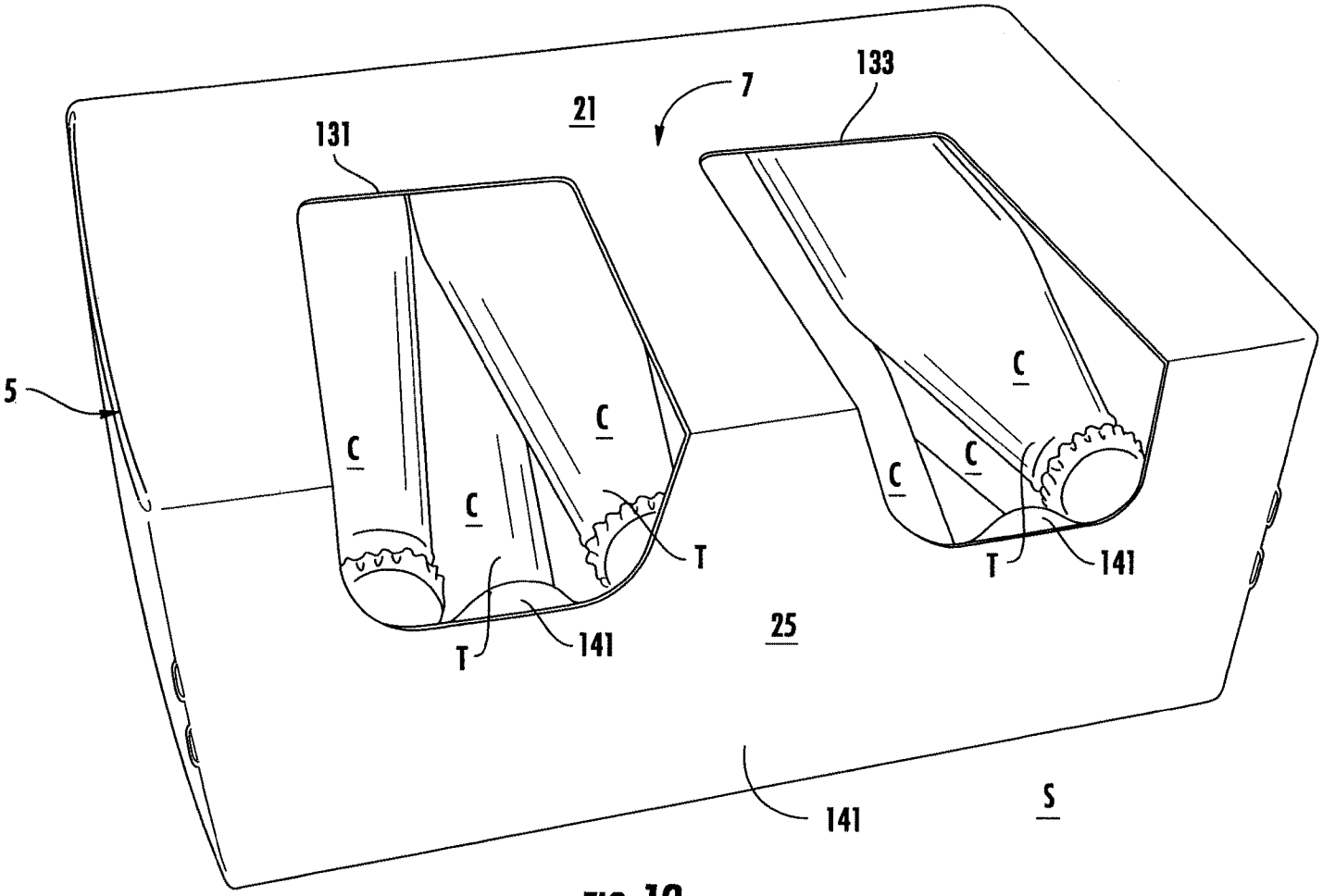
FIG. 12 is a view similar to FIG. 11 with the dispenser completely opened.
Figure 14:
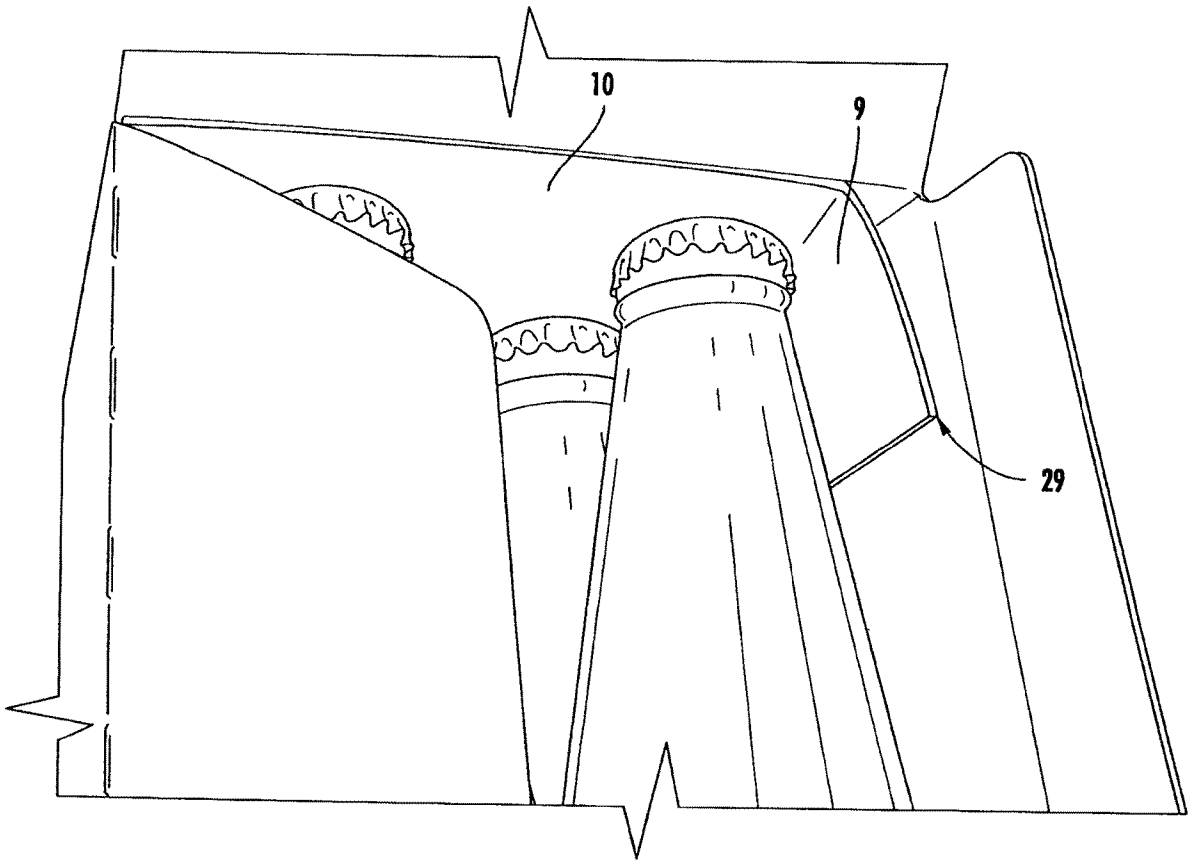
FIG. 14 is a view of a first corner support proximate a loaded article of the carton formed from the blank of FIG. 1.
Figure 15:
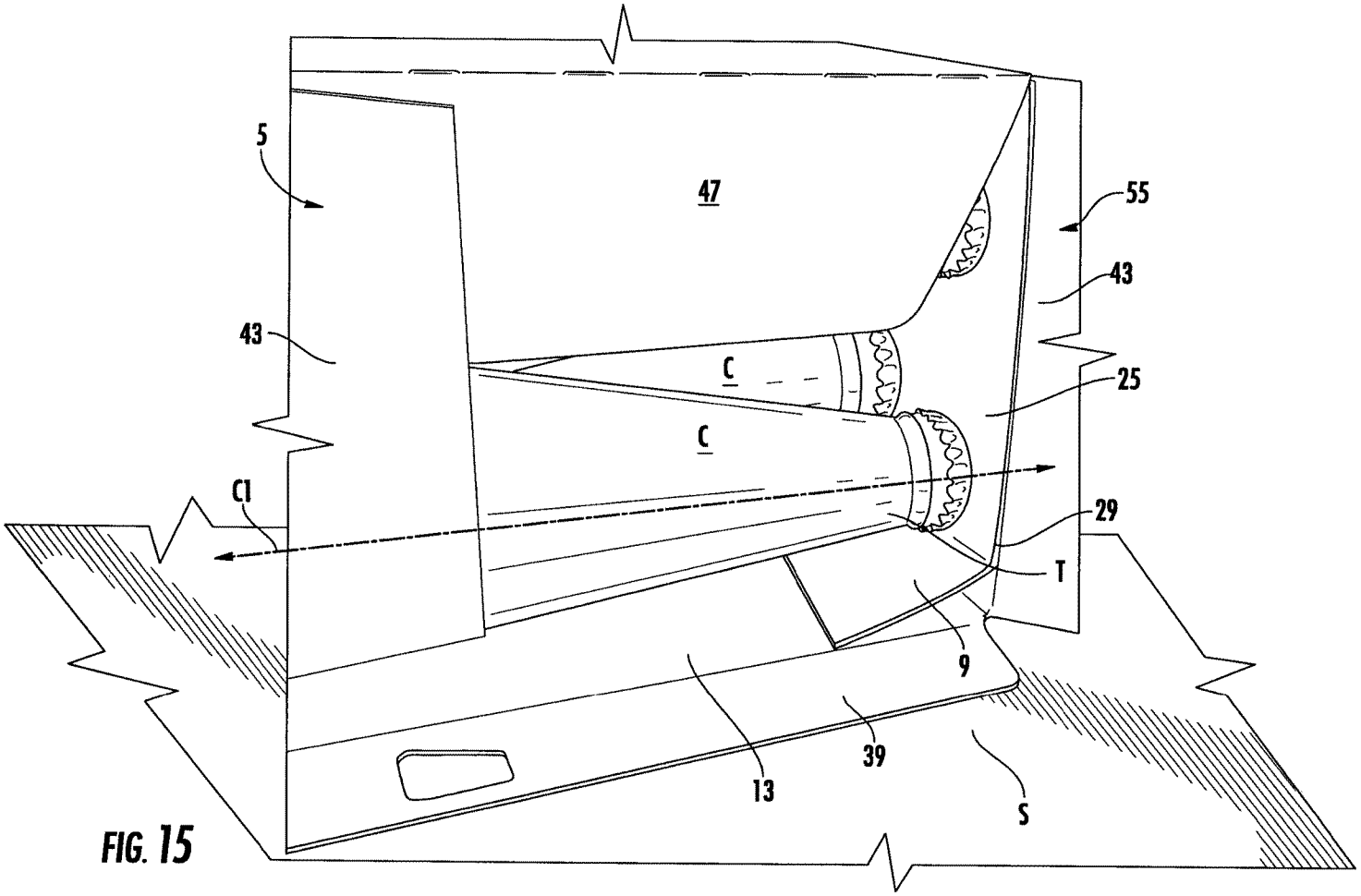
FIG. 15 is a view similar to FIG. 14, showing a centerline of the loaded article being maintained through the first corner support.

As shown in FIGS. 9, 14, and 15, the support 9 comprises the support flap 29 that is positioned to support the tops T of the containers C when the carton 5 is laid on the first side panel 13. For example and as shown in FIGS. 10 and 12, the carton 5 can be laid on the first side panel 13 when the carton is placed in a refrigerator or cooler so that the first side panel is in contact with a surface S (e.g., a shelf or support surface in a refrigerator) and the height of the carton is reduced. Reducing the height of the carton 5 by laying the carton on the first side panel 13 allows more efficient use of refrigerator space by allowing the carton to fit on a shelf (e.g. a bottom or middle shelf) having a smaller clearance height than if the carton 5 was placed in the refrigerator in the upright position (e.g., with the bottom panel 17 placed on a shelf or support surface).

Figure 11:
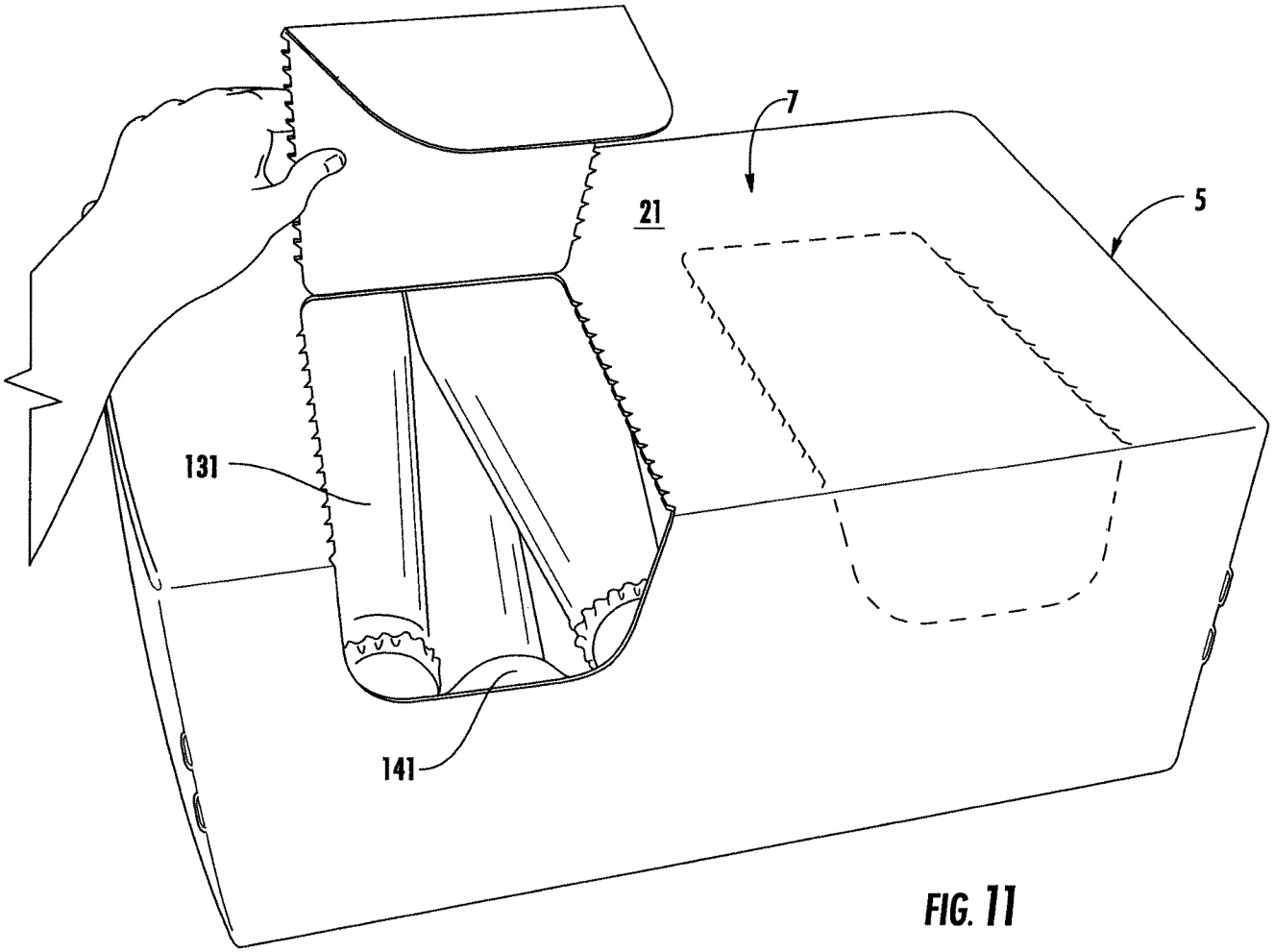
FIG. 11 is a view similar to FIG. 10 showing a partially opened dispenser of the carton.
Figure 13:
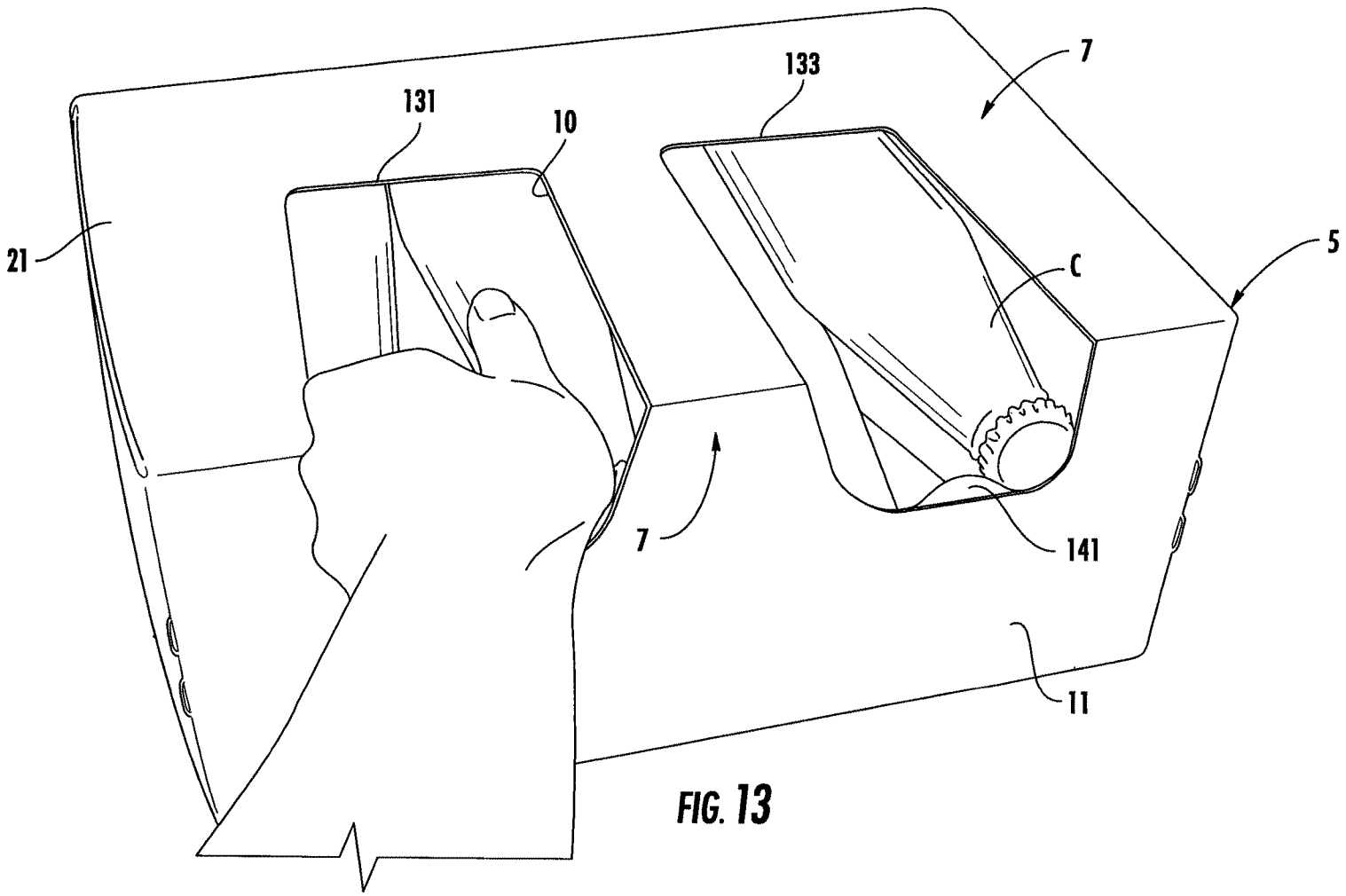
FIG. 13 is a view similar to FIG. 12, with an article being dispensed.

As shown in FIGS. 11-13, the dispenser 7 can be opened by grasping a portion of the second dispenser panel 105 and tearing the second dispenser panel and the first dispenser panel 101 along respective tear lines 107, 103 to form a first dispenser opening 131. Similarly, the dispenser 7 can be opened grasping a portion of the fourth dispenser panel 115 and tearing the fourth dispenser panel and the third dispenser panel 111 along respective tear lines 117, 113 to form a second dispenser opening 133. As shown in FIG. 13, containers C can be removed from the first dispenser opening 131 or the second dispenser opening 133 by a consumer. The support panel 29 forms the support 9 adjacent the first side panel 13 that supports the tops T of the containers C when the carton 5 is laid in the dispensing configuration with the first side panel 13 on the support surface S. The configuration of the portions of the dispenser panels 101, 105, 111, 115 in the overlapped top panels 11, 25 provides a retention portion 141 of the overlapped top panels that prevents the containers from unintentionally being removed through either of the dispenser openings 131, 133. The retention portion 141 is at least partially defined by the tear lines 103, 113 in the top panel 21. Furthermore, the retention portion 141 contacts the tops T of containers adjacent the dispenser opening. Alternatively, the dispenser 7 can comprise only one of the dispenser openings 131, 103, or the dispenser could be otherwise configured to have one or more openings of other shapes and sizes. Further, the dispenser 7 could alternatively include one or more dispenser panels in the first side panel 13 to allow the user to remove containers through dispenser opening(s) in the other side panel without departing from the disclosure. Also, the dispenser 7 could comprise one or more dispenser panels that comprise at least a portion of the bottom panel 17 without departing from the disclosure. Further, the dispenser 7 could be omitted without departing from the disclosure.

Alternatively, the dispenser 7 could comprise closure features wherein the dispenser openings 131, 133 can be closed such as by having one or more of the dispenser panels 101, 105, 111, 115 remaining foldably connected to one or more of the first top panel 11, second top panel 25, and the second side panel 21. Also, the carton 5 could have one or more handle features in one or more of the top panels 11, 25, the side panels 13, 21, or the closed ends 55, 57.

As shown in FIG. 12, the support flap 29 and the support 9 supports the tops T of the container C when the carton 5 is positioned with the first side panel 13 supported on a surface S. The support 9 supports the tops T of the containers in a manner that keeps the tops from contacting the side panel 13. Therefore, according to one embodiment, the containers C can be accessed by separating the folded and glued end flaps 35, 39, 43, 47 at the first end 55 of the carton or by separating the folded and glued end flaps 37, 41, 45, 49 at the second end 57 of the carton. The carton 5 could contain articles other than beverage containers C (e.g., food products, medical products, etc.) without departing from the disclosure. The use of the support 9 and support flap 29 without the dispenser 7 of the first embodiment, allows the carton 5 to be placed in a refrigerator or display case with one or the other side panels 13, 21 being in contact with a support surface S so that the articles C are supported and the carton requires a reduced height or clearance space for storage. As shown in FIG. 12, the row of containers adjacent the side panel 13 are prevented from tilting or sloping downward toward the side panel 13 by the location of the support 9 that contacts the tops T of the containers C. The support 9 and/or support flap 29 can be otherwise shaped, arranged, and/or positioned without departing from the disclosure.

Figure 16:
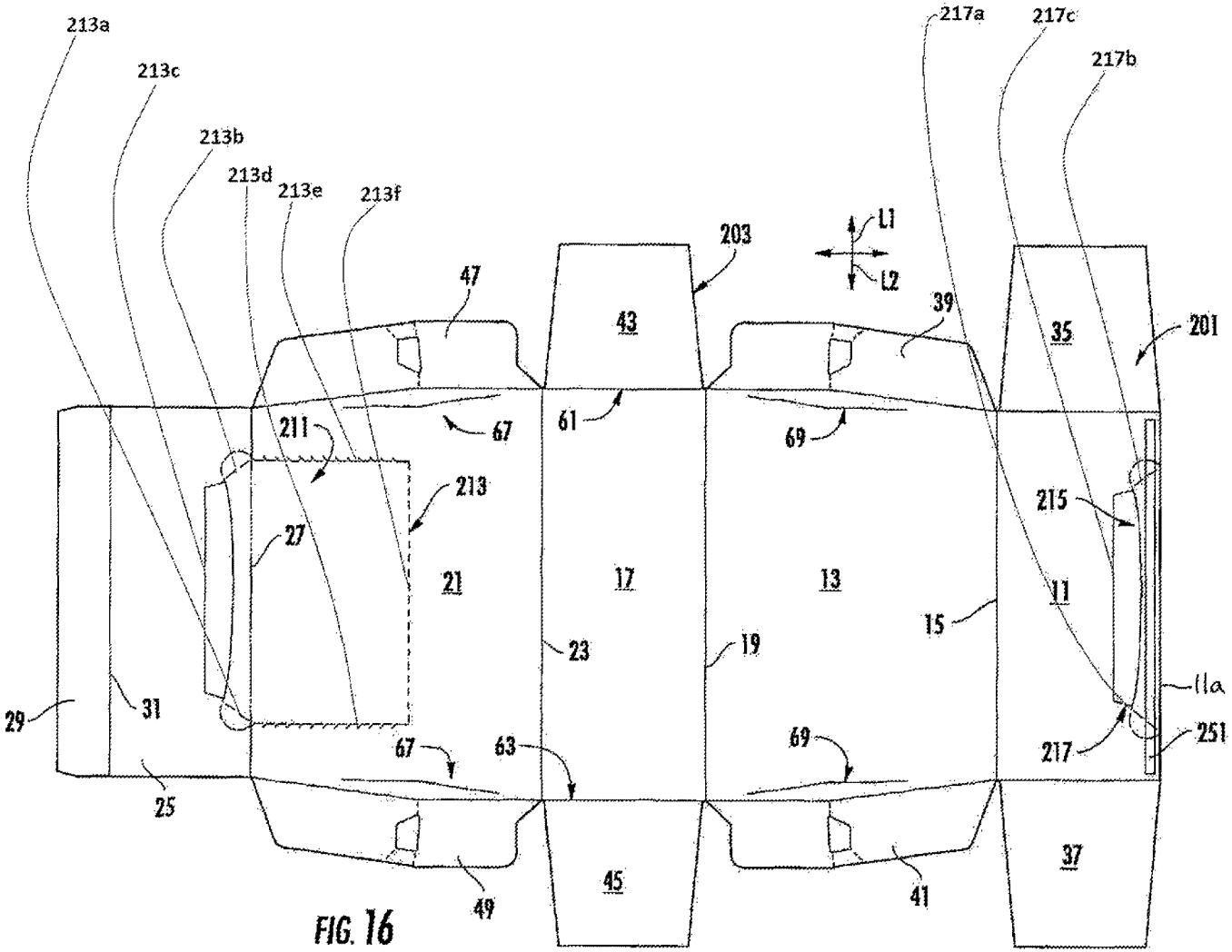
FIG. 16 is a plan view of an exterior surface of a blank for forming a carton of a second embodiment.

FIG. 16 shows a blank 201 of a second embodiment of the disclosure having similar features as the first embodiment. Accordingly, similar or identical features of the embodiments are provided with identical or similar reference numbers. The blank 201 a first dispenser panel 211 that is at least partially defined by a first tear line 213 and comprises a portion of the second side panel 21 and the second top panel 25, and a second dispenser panel 215 that is at least partially defined by a second tear line 217 and comprises a portion of the first top panel 11. The blank 201 further comprises an adhesive region 251 extending between fold lines 61, 63 for adhering the first top panel 11 and the second top panel 25 for forming a dispenser from the first and second dispenser panels.

In one embodiment, the first tear line 213 includes a first portion 213*a*, a second portion 213*b*, a third portion 213*c*, a fourth portion 213*d*, a fifth portion 213*e*, and a sixth portion

213*f*. The first portion 213*a* and the second portion 213*b* each extend from the fourth lateral fold line 27 and are in the second top panel 25. The fourth portion 213*d* and the fifth portion 213*e* each extend from the fourth lateral fold line 27 and are in the second side panel 21. The third portion 213*c* extends between the first portion 213*a* and the second portion 213*b*. In the illustrated embodiment, the second tear line 217 also includes a first portion 217*a*, a second portion 217*b*, and a third portion 217*c*. The first portion 217*a* and the second portion 217*b* each extend from a free edge 11*a* of the first top panel 11. The third portion 217*c* extends between the first portion 217*a* and the second portion 217*b*. When the blank 201 is formed into a carton, the respective portions 213*a*, 213*b*, and 213*c* of the first tear line 213 are in registration with the respective portions 217*a*, 217*b*, and 217*c* of the second tear line 217 to form the dispenser 7.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of articles, comprising:

a plurality of panels that extends at least partially around an interior of the carton, the plurality of panels comprises a first top panel having a free edge, a first side panel foldably connected to the first top panel at a first fold line, a bottom panel foldably connected to the first side panel, a second side panel foldably connected to the bottom panel, and a second top panel foldably connected to the second side panel at a third fold line, at least a portion of an interior surface of the first top panel is in face-to-face contact with an exterior surface of the second top panel;

a support foldably connected to the second top panel at a second fold line, the support comprises a support flap for supporting at least one article of the plurality of articles, and the first fold line is spaced apart from the second fold line, the second top panel extends across less than the entire width of the first top panel and the support flap extends downwardly from the second top panel at the second fold line so the interior surface of the first top panel has a portion that is free from contact with the second top panel, the support flap is free from attachment to the first side panel and the first top panel; and a dispenser for allowing removal of the plurality of articles from the carton, the dispenser comprises a first dispenser panel that is at least partially defined by a first tear line in at least one of the second side panel and the second top panel, and a second dispenser panel that is at least partially defined by a second tear line in the first top panel, wherein the first tear line has a first portion and a second portion each extending from the third fold line, and the second tear line has a third first portion and a second portion each extending from the free edge of the first top panel, at least a portion of the second dispenser panel overlaps at least a portion of the first dispenser panel, the first portion of the first tear line is in registration with the first portion of the second tear line portion, the second portion of the first tear line is in registration with the second portion of the second tear line, and the first dispenser panel and second dispenser panel are for being at least partially removed for at least further opening a dispenser opening.

2. The carton of claim 1, wherein the support flap is positioned to support a portion of at least one article of the plurality of articles above the second side panel.

3. The carton of claim 2, wherein the support flap is positioned at an oblique angle between the second top panel and the first side panel and has a free edge in contact with the first side panel.

4. The carton of claim 1, wherein the first dispenser panel and the second dispenser panel are in registration for forming the dispenser opening.

5. The carton of claim 1, wherein the first portion of the first tear line is in the second top panel and the first tear line further comprises a third portion in the second top panel extending between the first portion and the second portion of the first tear line.

6. The carton of claim 1, wherein the first top panel and the first side panel define a first corner of the carton, the second top panel and the second side panel define a second corner of the carton, the dispenser opening is adjacent the second corner, and the support flap is adjacent the first corner.

7. The carton of claim 6, wherein the support flap is positioned to extend across the first corner.

8. The carton of claim 1, wherein the support is in contact with the at least one article to maintain a central axis of the at least one article substantially parallel to the second side panel.

9. The carton of claim 1, wherein the plurality of articles are arranged in at least two layers, a first layer of the at least two layers having a first plurality of articles, and the support being configured to support the first plurality of articles.

10. The carton of claim 1, further comprising a plurality of end flaps foldably connected to a respective panel of the plurality of panels, the end flaps are configured to at least partially close at least one end of the carton.

11. The carton of claim 10, further comprising diamond corner panels that connect respective end flaps to the first side panel, the diamond corner panels being configured to allow the at least one end of the carton to taper inwardly to at least one of the first top panel and the second top panel from the bottom panel.

12. The carton of claim 1, wherein the dispenser comprises a retention portion in at least one of the first top panel and the second top panel, the retention portion retaining at least one article of the plurality of articles in the carton when the first dispenser panel and the second dispenser panel are removed.

13. The carton of claim 12, wherein the retention portion is at least partially defined by at least one of the first tear line and the second tear line, the retention portion contacting the top of the at least one article that is adjacent the dispenser opening.

14. The carton of claim 1, wherein the support flap has a free edge that is in contact with the first side panel, the support flap being free from any line of weakening between the second fold line and the free edge of the support flap.

15. The carton of claim 14, wherein the support flap is oblique relative to the first side panel across an entire length of the support flap extending from the second fold line to the free edge of the support flap.

16. The carton of claim 1, wherein at least a portion of the second tear line overlaps at least a portion of the first tear line.

17. The carton of claim 1, wherein the dispenser opening is a first dispenser opening, the dispenser further comprises a third dispenser panel that is at least partially defined by a third tear line in at least one of the second side panel and the second top panel, and a fourth dispenser panel that is at least partially defined by a fourth tear line in the first top panel, wherein at least a portion of the third dispenser panel overlaps at least a portion of the fourth dispenser, and the third dispenser panel and fourth dispenser panel are for being at least partially removed for at least further opening a second dispenser opening.

18. The carton of claim 1, wherein the first tear line further comprises a third portion extending between the first portion of the first tear line and the second portion of the first tear line, the second tear line comprises a third portion extending between the first portion of the second tear line and the second portion of the second tear line, and wherein the third portion of the first tear line and the third portion of the second tear line are in registration.

19. A blank for forming a carton for holding a plurality of articles, comprising:

a plurality of panels comprising a first top panel having a free edge, a first side panel foldably connected to the first top panel at a first fold line, a bottom panel foldably connected to the first side panel, a second side panel foldably connected to the bottom panel, and a second top panel foldably connected to the second side panel at a third fold line, at least a portion of an interior surface of the first top panel is for being in face-to-face contact with an exterior surface of the second top panel;

a support foldably connected to the second top panel at a second fold line, the support comprises a support flap for supporting at least one article of the plurality of articles and the first fold line is spaced apart from the second fold line, the second top panel has a width less than the width of the first top panel and the support flap is for extending downwardly from the second top panel at the second fold line so that the interior surface of the first top panel has a portion that is free from contact with the second top panel in the carton formed from the blank, the support flap is for being free from attachment to the first side panel and the first top panel in the carton formed from the blank; and dispenser features for forming a dispenser for allowing removal of the plurality of articles from the carton, the dispenser features comprise a first dispenser panel that is at least partially defined by a first tear line in at least one of the second side panel and the second top panel, and a second dispenser panel that is at least partially defined by a second tear line in the first top panel, wherein the first tear line has a first portion and a second portion each extending from the third fold line, and the second tear line has a first portion and a second portion each extending from the free edge of the first top panel, at least a portion of the second dispenser panel overlaps at least a portion of the first dispenser panel, the first portion of the first tear line is in registration with the first portion of the second tear line, the second portion of the first tear line is in registration with the second portion of the second tear line, and the first dispenser panel and second dispenser panel are for being at least partially removed for at least further opening a dispenser opening in the carton formed from the blank.

20. The blank of claim 19, wherein the support flap is positioned to support a portion of at least one article of the plurality of articles above the first side panel in the carton formed from the blank.

21. The blank of claim 20, wherein the support flap is for being positioned at an oblique angle between the second top panel and the first side panel so that a free edge of the support flap is in contact with the first side panel in the carton formed from the blank.

22. The blank of claim 19, wherein the first dispenser panel and the second dispenser panel are in registration for forming the dispenser opening.

23. The blank of claim 19, wherein the first portion of the first tear line is in the second top panel and the first tear line further comprises a third portion in the second top panel extending between the first portion and the second portion of the first tear line.

24. The blank of claim 19, wherein the support flap is for being in contact with the at least one article to maintain a central axis of the at least one article substantially parallel to the second side panel in the carton formed from the blank.

25. The blank of claim 19, further comprising a plurality of end flaps foldably connected to a respective panel of the plurality of panels, the end flaps are configured to at least partially close at least one end of the carton.

26. The blank of claim 25, further comprising diamond corner panels that connect respective end flaps to the first side panel, the diamond corner panels configured to allow the at least one end of a carton formed of the blank to taper inwardly to at least one of the first top panel and the second top panel from the bottom panel.

27. The blank of claim 19, wherein the dispenser features comprise a retention portion in at least one of the first top panel and the second top panel, the retention portion being for retaining at least one article of the plurality of articles in the carton formed from the blank when the first dispenser panel and the second dispenser panel are removed.

28. The blank of claim 27, wherein the retention portion is at least partially defined by at least one of the first tear line and the second tear line, the retention portion contacting the top of the at least one article that is adjacent the dispenser opening.

29. The blank of claim 19, wherein at least a portion of the second tear line overlaps at least a portion of the first tear line in the carton formed from the blank.

30. The blank of claim 19, wherein the dispenser opening is a first dispenser opening, the dispenser further comprises a third dispenser panel that is at least partially defined by a third tear line in at least one of the second side panel and the second top panel, and a fourth dispenser panel that is at least partially defined by a fourth tear line in the first top panel, wherein at least a portion of the third dispenser panel overlaps at least a portion of the fourth dispenser panel in the carton formed from the blank, and the third dispenser panel and fourth dispenser panel are for being at least partially removed for at least further opening a second dispenser opening of the carton formed from the blank.

31. The blank of claim 19, wherein the first tear line further comprises a third portion extending between the first portion of the first tear line and the second portion of the first tear line, the second tear line comprises a third portion extending between the first portion of the second tear line and the second portion of the second tear line, and wherein the third portion of the first tear line and the third portion of the second tear line are in registration in the carton formed from the blank.

32. A method of forming a carton for holding a plurality of articles, comprising:

obtaining a blank comprising a plurality of panels comprising a first top panel having a free edge, a first side panel foldably connected to the first top panel at a first fold line, a bottom panel foldably connected to the first side panel, a second side panel foldably connected to the bottom panel, and a second top panel foldably connected to the second side panel at a third fold line, a support comprising a support flap foldably connected to the second top panel at a second fold, and dispenser features for forming a dispenser for allowing removal of the plurality of articles from the carton, wherein the dispenser features comprise a first dispenser panel that is at least partially defined by a first tear line in at least one of the second side panel and the second top panel, and a second dispenser panel that is at least partially defined by a second tear line in the first top panel, the first tear line having a first portion and a second portion each extending from the third fold line, and the second tear line having a first portion and a second portion each extending from the free edge of the first top panel, at least a portion of the second dispenser panel overlapping at least a portion of the first dispenser panel;

positioning the plurality of panels to form an interior of the carton comprising positioning at least a portion of the interior surface of the first top panel in face-to-face contact with the exterior surface of the second top panel and positioning the first portion of the first tear line in registration with the first portion of the second tear line and the second portion of the first tear line in registration with the second portion of the second tear line;

positioning the support so that the first fold line is spaced apart from the second fold line, the second top panel extends across less than the entire width of the first top panel, and the support flap extends downwardly from the second top panel at the second fold line so the interior surface of the first top panel has a portion that is free from contact with the second top panel, the support flap is free from attachment to the first side panel and the first top panel; and loading a plurality of articles in the interior of the carton, the loading the articles comprising positioning at least one article of the plurality of articles for contact with the support flap.

33. The method of claim 32, further comprising positioning the carton so that the at least one article is in contact with the support and at least partially removing the first dispenser panel and the second dispenser panel to form a dispenser opening allowing access to the at least one article in the interior of the carton.

34. The method of claim 33, wherein the dispenser opening is a first dispenser opening, the dispenser further comprises a third dispenser panel that is at least partially defined by a third tear line in at least one of the second side panel and the second top panel, and a fourth dispenser panel that is at least partially defined by a fourth tear line in the first top panel, wherein at least a portion of the third dispenser panel overlaps at least a portion of the fourth dispenser panel, and the method further comprises at least partially removing the third dispenser panel and the fourth dispenser panel to form a second dispenser opening allowing access to the at least one article in the interior of the carton.

35. The method of claim 32, further comprising positioning the support flap to support a portion of at least one article of the plurality of articles above the first side panel.

36. The method of claim 35, further comprising positioning the support flap at an oblique angle between the second top panel and the first side panel so that a free edge of the support flap is in contact with the first side panel.

37. The method of claim 35, further comprising positioning the first dispenser panel and the second dispenser panel in registration to form the dispenser.

38. The method of claim 35, first portion of the first tear line is in the second top panel and the first tear line further comprises a third portion in the second top panel extending between the first portion and the second portion of the first tear line.

39. The method of claim 35, wherein the positioning the plurality of panels comprises forming a first corner of the carton at least partially defined by the first top panel and the first side panel, forming a second corner of the carton at least partially defined by the second top panel and the second side panel, the dispenser is adjacent the second corner, and the support flap is adjacent the first corner.

40. The method of claim 39, further comprising positioning the support flap to extend across the first corner.

41. The method of claim 32, further comprising positioning the carton on a support surface so that the first side panel is in contact with the support surface, the positioning the carton comprises contacting the support with the at least one article to maintain a central axis of the at least one article substantially parallel to the second side panel.

42. The method of claim 41, wherein the loading the articles comprises arranging the plurality of articles in at least two layers, a first layer of the at least two layers having a first plurality of articles adjacent the first side panel and a second layer of the at least two layers having a second plurality of articles, and the at least one article comprises the first plurality of articles.

43. The method of claim 32, wherein the blank further comprises a plurality of end flaps foldably connected to a respective panel of the plurality of panels, the method further comprises closing at least one end of the carton by at least partially overlapping the end flaps.

44. The method of claim 43, wherein the blank further comprises diamond corner panels that connect respective end flaps to the first side panel, the closing at least one end comprises positioning the diamond corner panels to allow the at least one end of the carton to taper inwardly to at least one of the first top panel and the second top panel from the bottom panel.

45. The method of claim 32, wherein the dispenser comprises a retention portion in at least one of the first top panel and the second top panel, the retention portion retaining at least one article of the plurality of articles in the carton when the first dispenser panel and the second dispenser panel are removed.

46. The method of claim 45, wherein the retention portion is at least partially defined by at least one of the first tear line and the second tear line, the retention portion contacting the top of the at least one article that is adjacent the dispenser opening.

47. The method of claim 32, further comprising positioning at least a portion of the second tear line to overlap at least a portion of the first tear line.

48. The method of claim 32, wherein the first tear line further comprises a third portion extending between the first portion of the first tear line and the second portion of the first tear line, the second tear line comprises a third portion extending between the first portion of the second tear line and the second portion of the second tear line, and wherein the method further comprises positioning the third portion of the first tear line and the third portion of the second tear line to be in registration.

* * * * *